United States Patent [19]

Matyas

[11] 4,208,970

[45] Jun. 24, 1980

[54] MOVABLE LADING BRACING STANCHIONS FOR FREIGHT CARS

[75] Inventor: Tibor Matyas, Woodridge, Ill.

[73] Assignee: Evans Products Company, Chicago, Ill.

[21] Appl. No.: 861,868

[22] Filed: Dec. 19, 1977

[51] Int. Cl.[2] ..... B60P 17/14; B61D 17/10; B61D 45/00; B61D 49/00

[52] U.S. Cl. ..... 410/153; 410/134

[58] Field of Search ..... 105/368 R, 376, 486, 105/489, 494, 499, 502, 504

[56] References Cited

U.S. PATENT DOCUMENTS

| | | | |
|---|---|---|---|
| 2,563,799 | 8/1951 | Nampa | 105/502 |
| 2,827,960 | 3/1958 | Keating et al. | 105/504 X |
| 2,834,304 | 5/1958 | Chapman et al. | 105/376 X |
| 2,873,695 | 2/1959 | Tobin | 105/499 |
| 2,956,517 | 10/1960 | Chapman et al. | 105/368 R |
| 2,974,612 | 3/1961 | Stough | 105/504 |
| 3,095,830 | 7/1963 | Runken | 105/463 |
| 3,217,664 | 11/1965 | Aguino et al. | 105/376 |
| 3,478,700 | 11/1969 | Lundvall et al. | 105/504 |
| 3,570,416 | 3/1971 | Shook | 105/376 |
| 3,720,174 | 3/1973 | Heard | 105/376 |

*Primary Examiner*—Trygve M. Blix
*Assistant Examiner*—Howard Beltran
*Attorney, Agent, or Firm*—Harness, Dickey & Pierce

[57] ABSTRACT

A movable stanchion for bracing freight in a transporting vehicle such as a railroad car or the like. The stanchion is supported for movement along the length of the cargo area of the car by an overhead track. A locking device carried by the stanchion cooperates with the overhead track and a floor mounted track to lock the stanchion in preselected bracing positions. The stanchion has a bracing face that extends transversely to its direction of movement and which is substantially less in the transverse direction than one-half of the width of the cargo area. The stanchion also has a device which cooperates with the floor mounted track so as to prevent pivotal movement in a transverse direction.

11 Claims, 11 Drawing Figures

MOVABLE LADING BRACING STANCHIONS FOR FREIGHT CARS

BACKGROUND OF THE INVENTION

This invention relates to a freight bracing device and more particularly to a movable stanchion for bracing freight in a transporting vehicle.

Various devices have been proposed for bracing freight in transporting vehicles such as railroad cars or the like. Such bracing devices have taken the form of bulkheads or cross bars and cooperating belt rails. Although each type of system has advantages, these known systems also have disadvantages for certain types of application. For instance, many types of loading do not require bracing devices that extend completely across the width of the transporting vehicle. Typical of such loads are large appliance cartons. It has been found that such loads may be conveniently and effectively braced by bracing devices that do not extend completely across the face of the load. Such loads may be braced by relatively narrow stanchions, which have the effect of substantially reducing the weight of the bracing device, but which nevertheless provide the advantage of having a permanent installation in the transporting vehicle.

It is, therefore, a principal object of this invention to provide an improved freight bracing device.

It is another object of the invention to provide a freight bracing stanchion for use in transporting vehicles.

SUMMARY OF THE INVENTION

This invention is adapted to be embodied in a freight bracing device for bracing freight within a cargo area defined by a freight transporting vehicle. The vehicle has at least one track extending along at least a portion of the length of the cargo area. The bracing device comprises a stanchion extending vertically in the cargo area and having a vertically extending bracing surface that extends transversely across the cargo area for engaging and retaining freight having a substantially greater width than the transverse dimension of the stanchion bracing surface. The stanchion bracing surface extends transversely for substantially less than one-half of the width of the cargo area. Means carried by the stanchion serve to support the stanchion for movement along the cargo area on the track to preselected cargo bracing positions. Means are provided for locking the stanchion in selected bracing positions relative to the cargo area.

DETAILED DESCRIPTION OF THE PREFERRED EMBODIMENTS

Figure 1:
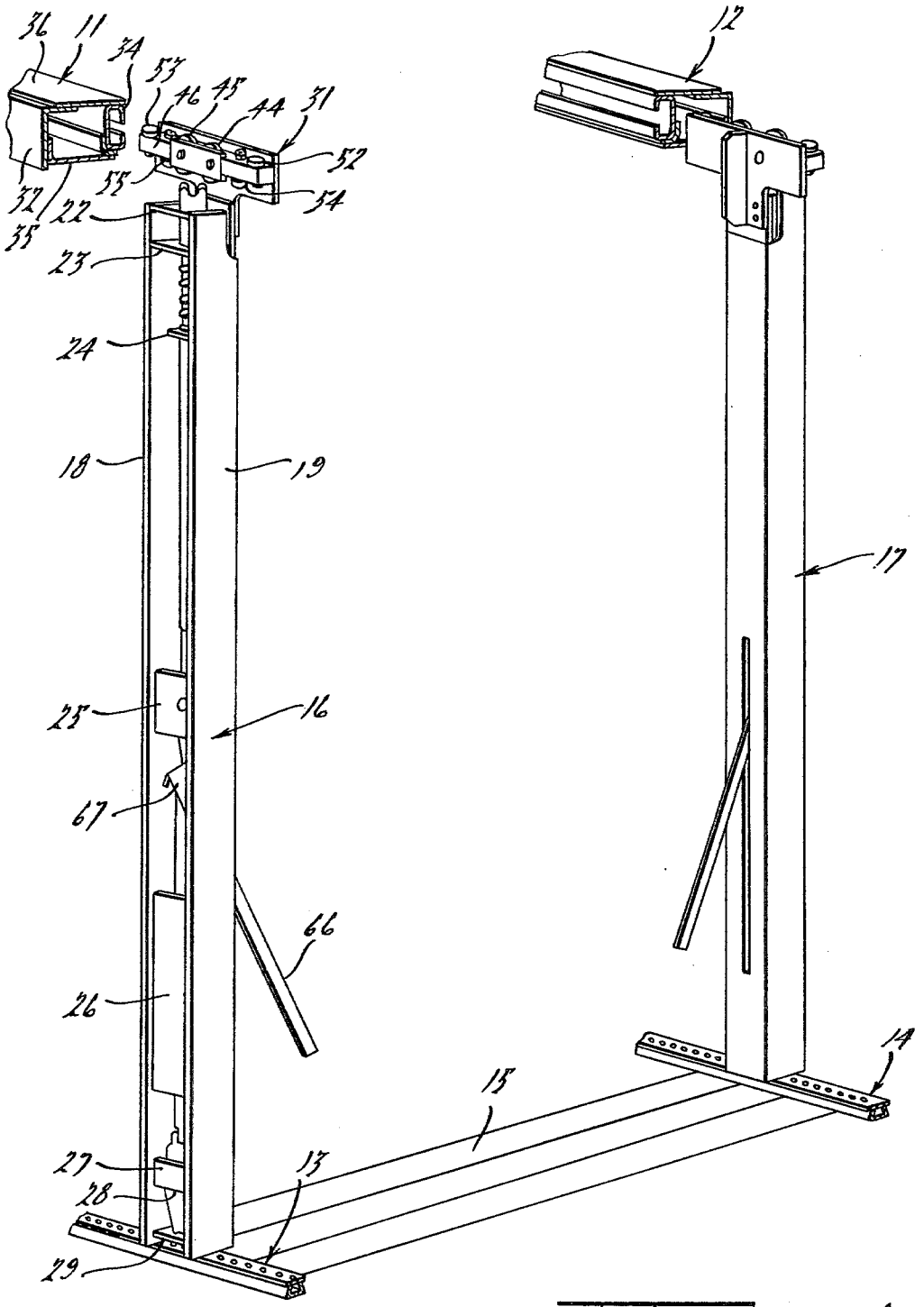
FIG. 1 is a perspective view, with portions broken away, of a freight transporting vehicle embodying the invention.
Figure 2:
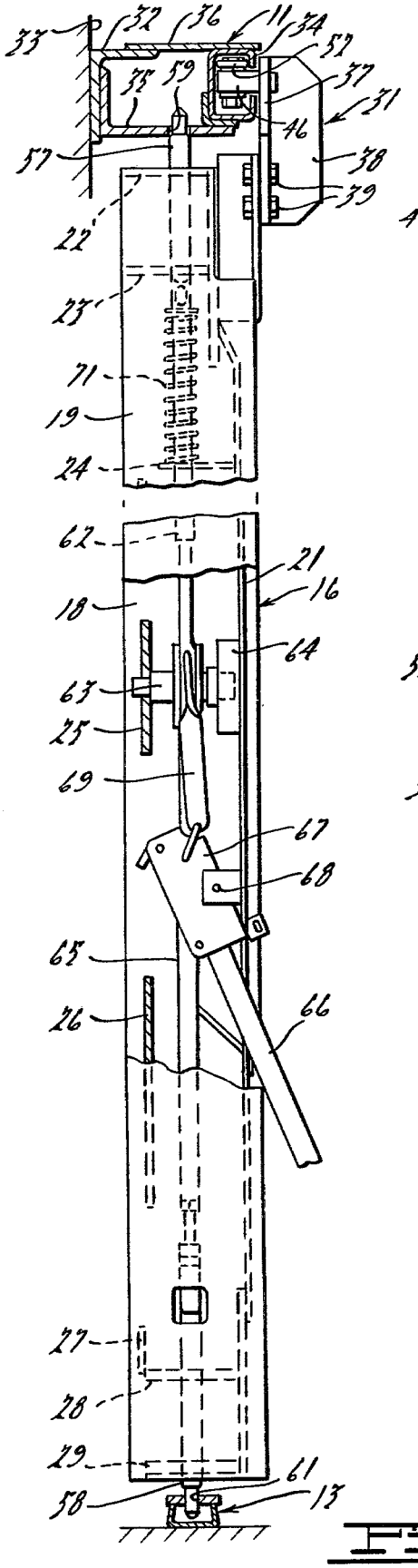
FIG. 2 is an enlarged end elevational view of one of the freight bracing stanchions, with portions shown in section and other portions broken away.
Figure 3:
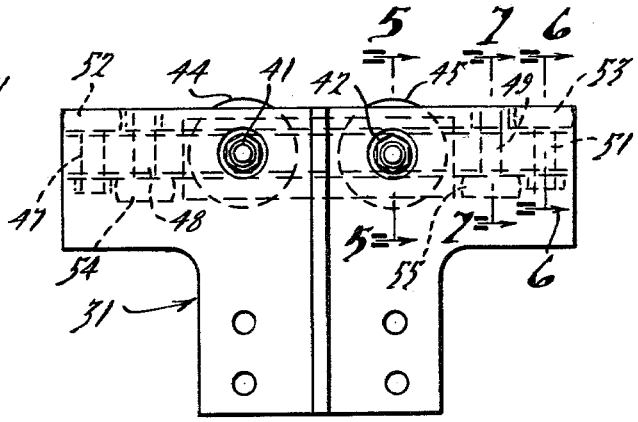
FIG. 3 is a side elevational view of a trolley structure employed for supporting the stanchion.
Figure 4:
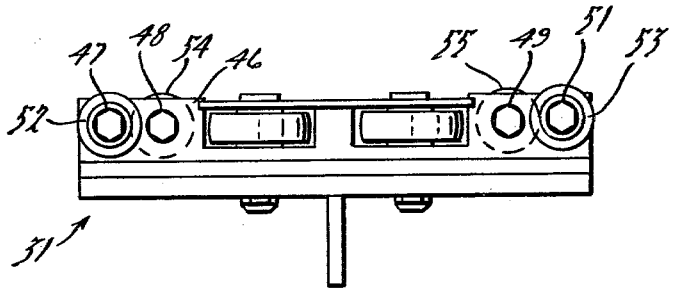
FIG. 4 is a top plan view of the trolley structure shown in FIG. 3.

Referring first to FIG. 1, a portion of a freight transporting vehicle embodying the invention is illustrated. For the sake of illustration, a railway box car has been depicted, but it is to be understood that the invention may be used in conjunction with any transporting vehicle which defines a cargo area as adapted to receive goods to be shipped. In accordance with the invention, the railway car is provided with a pair of overhead tracks, indicated generally by the reference numerals 11 and 12. The tracks 11 and 12 have the same configuration symmetrically about a plane passing through the center of the cargo area of the car. A pair of floor mounted latching strips or tracks 13 and 14 are also carried by the car and are recessed into the car floor 15. The latching strips 13 and 14 are positioned approximately beneath the tracks 11 and 12, respectively. At each side of the car, one or more vertical stanchions, indicated generally by the reference numerals 16 and 17, cooperate with the respective tracks 11, 12 and locking strips 13, 14. As will become apparent, the stanchions 16 and 17 are adapted to engage and brace the corners of large articles which may be shipped in the car. As has been noted, any number of stanchions may be employed on either side of the car. In most normal applications, a total of four stanchions will be used in a given installation, there being two for each end of the car when viewed relative to the doorway opening.

The construction of the stanchions 16 and 17 in cooperation with the tracks 11, 12 and locking strips 13 and 14 will now be described by continued reference to FIG. 1, as well as with the remaining figures. Inasmuch as the stanchions 16 and 17 are identical in construction, except for being symmetrically opposite, only the stanchion 16 and its cooperation with track 11 and locking strip 13 will be described.

The stanchion 16 is comprised of a vertically extending bracing member having a generally I-beam configuration fabricated from side plates 18 and 19 that are connected together by means of a vertically extending webb 21. The webb 21 is disposed off-center relative to the side plates 18 and 19 closer to the center of the associated car. Plates 22, 23, 24, 25, 26, 27, 28 and 29 also extend between the plates 18 and 19 to provide structural integrity and for supporting various components of the locking mechanism, as will be described.

Figure 5:
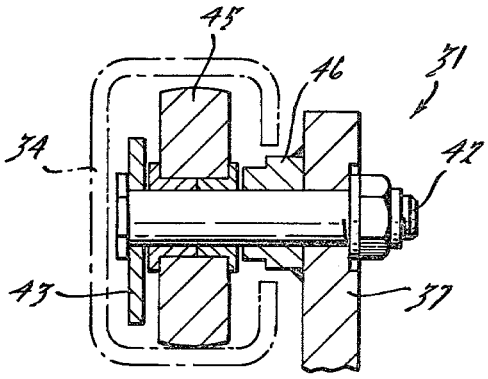
FIG. 5 is an enlarged cross-sectional view taken along the line 5—5 of FIG. 3, with the track being shown in phantom.

A trolley structure, indicated generally by the reference numeral 31, cooperates with the track 11 to support the stanchion 16 for movement along the length of the cargo area. The track 11 extends for a substantial length along the cargo area, the actual extent being dependent upon the particular application. The track 11 is a fabricated structure comprised of an angle 32 that is affixed in any suitable manner, as by welding to the side wall 33 of the car. A generally C-shaped structural member 34 is supported inwardly of the car from the angle 32 by means of a lower angle 35 and a plate 36. The trolley structure 31 is comprised of an upstanding T-shaped plate 37 which is reinforced by a gusset 38. The plate 37 is fixed to the plate 21 of the I-beam structure or to an extension of this plate by means of bolts and nuts 39. A pair of roller shafts 41 and 42 are fixed to the plate 37 and supported at their outer ends by means of a plate 43. Rollers 44 and 45 are journalled on the shafts 41 and 42, respectively, and extend into the channel-shaped member 34, as may best be seen in FIG. 5 so as to provide vertical support for the stanchion 16.

Figure 7:
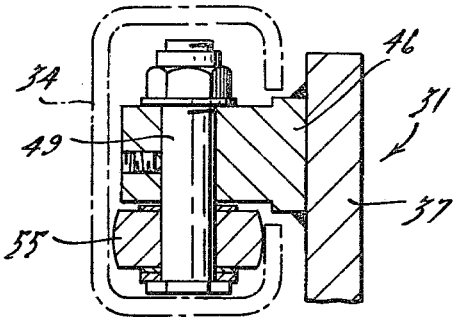
FIG. 7 is an enlarged cross-sectional view taken along the line 7—7 of FIG. 3, with the track being shown in phantom.

Spaced outwardly of the rollers 44 and 45 and fixed to the plate 37 is a structural member 46. Pairs of roller shafts 47, 48 and 49, 51 are positioned on opposite sides of the roller shafts 41 and 42. The shafts 47 and 51 carry respective rollers 52 and 53 which engage the short legs of the C-shaped member 34 at the upper half of the trolley structure. In a like manner, rollers 54 and 55 are carried by the shafts 48 and 49, respectively, and engage the common leg of the C-shaped member 34 (FIG. 7). The cooperation of the rollers 44, 45, 52, 53, 54 and 55 with the C-shaped member 34 provides an effective roller engagement while minimizing the likelihood of cocking in all directions.

The stanchion 16 also includes a locking arrangement for locking the stanchion 16 in preselected bracing positions along the cargo area. The locking mechanism includes an upper locking pin 57 that is slidably supported by the plates 22 and 23 and a lower locking pin 58 that is slidably supported by the plates 28 and 29. The upper locking pin 57 has a pair of projections which are adapted to extend into adjacent apertures 59 formed in the angle 35 of the track 11 so as to lock the upper end of the stanchion 16 relative to the track 11. In a like manner, the lower pin 58 has a pair of projections that are adapted to extend into adjacent apertures 61 of the lower locking strip 13 so as to lock the lower end of the stanchion 16 in place.

The locking pin 57 is connected by a pivot pin to a link 62, the lower end of which is connected to a crank fixed to a shaft 63 that is journalled by the plate 25 and a journal structure 64 fixed to the plate 21. A similar link 65 connects the lower locking pin 58 to the shaft 63. An operating handle 66 is slidably supported within a bracket 67 which is journalled by means of a pivot pin 68 on the plate 21. The bracket 67 is connected to a link 69 which, in turn, is connected to a crank arm that is fixed to the shaft 63 so as to rotate the shaft 63 and operate the locking pins 57 and 58 upon pivotal movement of the bracket 67 about the pivot pin 68. As described in U.S. Pat. No. 3,570,416, entitled Freight Bracing Apparatus, which issued Mar. 16, 1971 in the name of Jackson A. Shook and assigned to the assignee of this application, the handle 66 is slidable so that it may be accessible inwardly of the car or may be pulled outwardly through the opening of the doorway of the car. The construction of the operating mechanism may be best understood by reference to said patent No. 3,570,416.

A coil compression spring 71 bears against the plate 24 and the locking pin 57 so as to urge the locking pins 57 and 58 to their engaged position.

The drawings illustrate the stanchion 16 in a locked bracing position in the car. In this position the stanchion 16 has either its plate 18 or 19 in engagement with a corner of the load face. It will be noted that the vertically extending bracing surfaces provided by the plates 18 and 19 extend transversely a substantially less distance than one-half of the width of the cargo area. In addition, the surface of the plates 18 and 19 extend substantially less than the width of the load being braced. However, it has been found with certain types of loads such as large cartons that this is the only engagement necessary to effectively brace the freight.

Pivotal movement of the handle 66 and bracket 67 effects release of the locking pins 58 and 59 and permits the stanchion 16 to be moved away from the load for unloading or against the load during loading. The trolley structure 31 supports the stanchion 16 for this movement.

Figure 8:
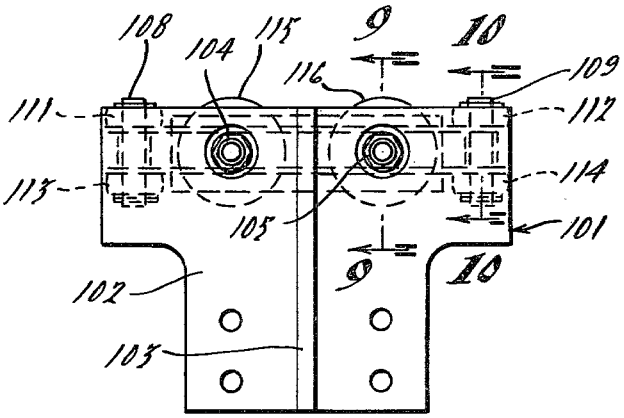
FIG. 8 is a side elevational view of another embodiment of a trolley which may be employed with the stanchion.
Figure 10:
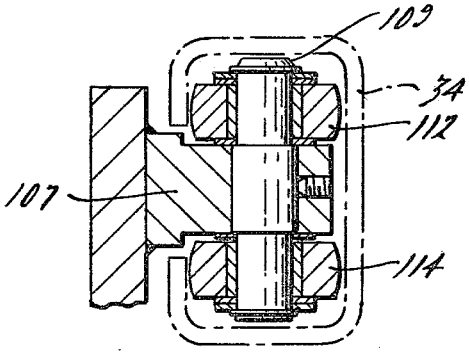
FIG. 10 is an enlarged cross-sectional view taken along the line 10—10 in FIG. 8, with the track being shown in phantom.
Figure 9:
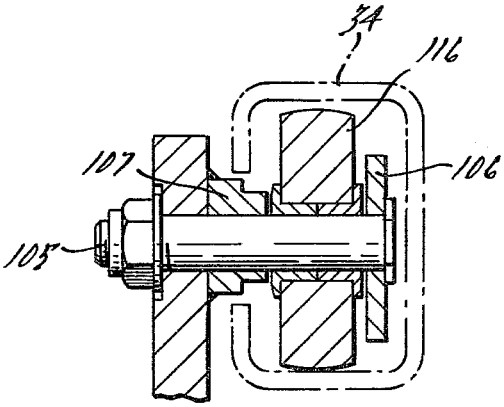
FIG. 9 is an enlarged cross-sectional view of the stanchion shown in FIG. 8 taken along the line 9—9 of this Figure, with the track being shown in phantom.

FIGS. 8 through 10 illustrate an alternative trolley structure which may be used in conjunction with this invention. This alternative trolley structure is indicated generally by the reference numeral 101. The trolley structure 101 includes a T-shaped plate 102 that is reinforced by a gusset 103. Pairs of roller shafts 104 and 105 are supported by the plate 102 and by means of a strap 106. The strap 106 is, in turn, affixed to a structure member 107 that extends perpendicular to the plate 102.

Pairs of spaced roller shafts 108 and 109 are fixed to the member 107. Each shaft 108 and 109 journals respective upper and lower rollers 111, 112 and 113, 114. The shafts 104 and 105 also support rollers 115 and 116. As may be seen in FIG. 9, the rollers 115 and 116 provide vertical support through contact with the lower leg of the C-shaped member 34. The rollers 111–114 contact the vertically extending faces of the C-shaped member 34 so as to provide transverse support. The trolley embodiment 101 has the advantage over the trolley embodiment 31 of being lighter in weight and more conpact in construction. Because of its lesser axial extend relative to the C-shaped member 34, however, this structure does not provide the same degree of resistance to cocking.

Figure 11:
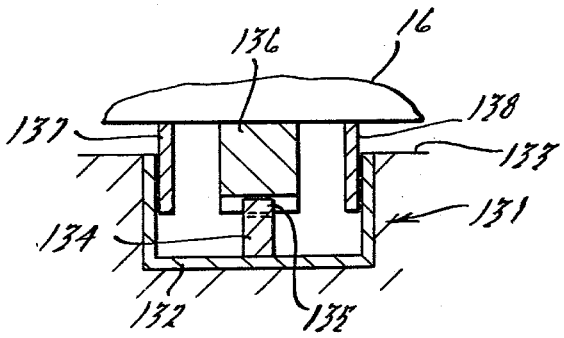
FIG. 11 is a cross-sectional view, in part similar to the lower portion of FIG. 2, but on a larger scale and showing a further embodiment of the invention.
Figure 6:
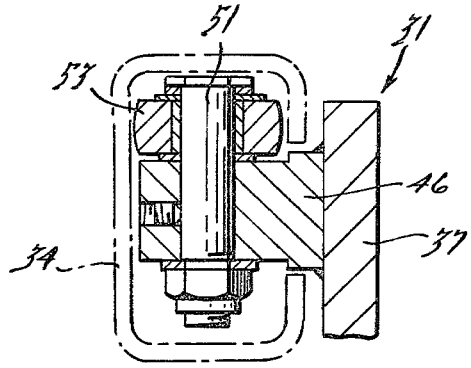
FIG. 6 is an enlarged cross-sectional view taken along the line 6—6 of FIG. 3, with the track being shown in phantom.

It should be apparent that due to the extreme length of the stanchion 16, an unacceptable bending load may be exerted on the track 11 as the lower end of the stanchion 16 is fixed in a transverse direction. FIG. 11 depicts an embodiment wherein a structure is provided to reduce these bending loads. Referring now to this figure, the lower track is identified generally by the reference numeral 131. The track 131 is of the so-called cleanable type and embodies a channel 132 that is recessed into the floor 133 of the car. A vertically extending locking strip 134 having notched teeth 135 is affixed to the center of the channel 132. An appropriately configured locking pin 136 carried by the stanchion 16 cooperates with the locking strip 134 so as to lock the stanchion 16 in position.

A pair of bearing plates 137 and 138 are fixed to the stanchion 16 and extend downwardly between the upstanding legs of the channel 132. The bearing plates 137 and 138 will engage the size of the channel 132 and preclude any substantial transverse movement of the stanchion 16. Thus, bending loads on the track 11 and trolley 31 are substantially minimized.

It is to be understood that the foregoing description is that of preferred embodiments of the invention. The invention is, however, susceptible of charges and variations without departing from its spirit and scope as set forth in the appended claims.

What is claimed is:

1. A freight bracing device for bracing freight within a cargo area defined by a freight transporting vehicle body having at least one track extending along at least a portion of the length of the vehicle body in the cargo area spaced inwardly of the side of the vehicle body, said freight bracing device comprising a stanchion extending vertically in said cargo area and having a vertically extending bracing surface extending transversely across said cargo area for directly engaging and restraining freight which freight has a substantially greater width than the transverse dimension of said stanchion bracing surface, and stanchion bracing surface extending transversely for substantially less than one-half of the width of said cargo area, means carried by said stanchion for supporting said stanchion for movement along said cargo area on said track to preselect cargo bracing areas, and locking means having selectively engageable surfaces for locking said stanchion in selected bracing positions relative to said cargo area.

2. A freight bracing device as claimed in claim 1 wherein the track is positioned at the upper portion of the vehicle cargo area.

3. A freight bracing device as claimed in claim 2 wherein the means for supporting the stanchion for movement along the cargo area comprises roller means cooperating with the track.

4. A freight bracing device as claimed in claim 3 wherein the roller means comprises a trolley structure having a pair of spaced shafts and rollers carried by said shafts and engaging said track for supporting said stanchion for movement therealong.

5. A freight bracing device as claimed in claim 4 wherein the trolley structure comprises two pairs of separate shafts and rollers, one of said pairs of shafts and rollers being disposed for rotation about an axis perpendicular to the axis of the other of said pairs whereby one of said pairs provides vertical support for said stanchion and the other of said pairs provides resistence to transverse movement.

6. A freight bracing device as claimed in claim 2 further including means carried by the stanchion and cooperating with means carried by the freight transporting vehicle for precluding pivotal movement of said stanchion relative to the track about an axis parallel to the direction of movement of said stanchion along said track and when said locking means is released.

7. A freight bracing device as claimed in claim 6 wherein the locking means comprises means carried by said stanchion cooperative with the track.

8. A freight bracing device as claimed in claim 6 wherein the means carried by the stanchion for precluding pivotal movement comprises abutment means and the means carried by the vehicle for precluding pivotal movement comprises a lower strip having abutting means cooperating with said stanchion abutment means said abutment means being provided by other than said locking means surfaces.

9. A freight bracing device as claimed in claim 7 wherein the locking means comprises locking means surfaces provided by the track and the strip and cooperating upper and lower locking means carried by said stanchion and providing the respective cooperating surface.

10. A freight bracing device as claimed in claim 9 wherein the locking strip comprises a channel-shaped member adapted to be positioned in the floor of the transporting vehicle and a latching strip positioned therein said latching strip providing said locking means surfaces and said channel shaped member providing said cooperative means.

11. A freight bracing device for bracing freight within a cargo area defined by a freight transporting vehicle body having a pair of tracks extending along at least a portion of the length of the vehicle body in the cargo area on opposite sides thereof spaced inwardly from the respective side of the vehicle body, said freight bracing device comprising a pair of stanchions extending vertically in said cargo area and each having a vertically extending bracing surface extending transversely across said cargo area for directly engaging and restraining freight which freight has a substantially greater width than the transverse dimension of said stanchion bracing surface, said stanchion bracing surface extending transversely less than one-half of the width of said cargo area, means carried by each of said stanchions for supporting said stanchions for movement along said cargo area on a respective one and locking means having selectively engagable surfaces for locking each of said stanchions in selected bracing positions relative to said cargo area.

* * * * *

UNITED STATES PATENT AND TRADEMARK OFFICE

CERTIFICATE OF CORRECTION

PATENT NO. : 4,208,970

DATED : June 24, 1980

INVENTOR(S) : Tibor Matyas

It is certified that error appears in the above-identified patent and that said Letters Patent are hereby corrected as shown below:

Col 3, line 32, "engagement" should be ---arrangement---; Col. 5, line 3, "charges" should be---changes---; Col. 5, line 18, "and" should be ---said--- Col. 6, line 45, after "one" insert ---of said tracks to preselect cargo bracing area,---; References cited: No. 3,217,664, "Aguino et al" should be ---Aquino et al ---.

Signed and Sealed this

*Ninth* Day of *September 1980*

[SEAL]

*Attest:*

SIDNEY A. DIAMOND

*Attesting Officer*

*Commissioner of Patents and Trademarks*